United States Patent [19]

Bedell

[11] 4,453,654

[45] Jun. 12, 1984

[54] CONTINUOUS CASTING NOZZLE WITH TRANSVERSE REINFORCEMENT STRUCTURE

[75] Inventor: John R. Bedell, Madison, N.J.

[73] Assignee: Electric Power Research Institute, Inc., Palo Alto, Calif.

[21] Appl. No.: 389,071

[22] Filed: Jun. 16, 1982

[51] Int. Cl.[3] ..... B22D 41/08

[52] U.S. Cl. ..... 222/594; 222/545; 222/547; 222/573; 164/423

[58] Field of Search ..... 222/594, 591, 606, 564, 222/490, 491, 494, 544, 545, 547, 206, 215, 573, 566, 567, 478, 488; 164/463, 462, 423; 239/597

[56] References Cited

U.S. PATENT DOCUMENTS

| | | | |
|---|---|---|---|
| 284,172 | 9/1883 | Brainerd | 222/564 |
| 2,128,941 | 9/1938 | Hudson | 222/591 X |
| 2,467,594 | 4/1949 | Nichols | 222/478 X |
| 2,564,723 | 8/1951 | Rossi . | |
| 2,744,666 | 5/1956 | Jacobs et al. | 222/554 X |
| 2,790,216 | 4/1957 | Hunter . | |
| 2,801,839 | 8/1957 | Lemmer . | |
| 2,823,487 | 2/1958 | Mandlak | 222/148 |
| 2,978,761 | 4/1961 | Foye et al. | 164/431 |
| 3,297,211 | 1/1967 | Unger | 222/567 X |
| 3,917,130 | 11/1975 | Nigorikawa et al. . | |
| 4,138,020 | 2/1979 | Steiner et al. | 222/564 X |
| 4,142,571 | 3/1979 | Narasimhan . | |
| 4,257,830 | 3/1981 | Tsuya et al. . | |

FOREIGN PATENT DOCUMENTS

| | | | |
|---|---|---|---|
| 1161668 | 9/1958 | France | 164/423 |
| 54-137436 | 10/1979 | Japan . | |
| 549212 | 11/1942 | United Kingdom . | |

*Primary Examiner*—Joseph J. Rolla
*Assistant Examiner*—Thomas C. Fitzgerald
*Attorney, Agent, or Firm*—King and Liles

[57] ABSTRACT

A continuous casting nozzle has a relatively narrow dispensing slot reinforced against flexing along its length by intermittent supporting structure. The nozzle may be a tubular insert member to be received in a mounting means, such as a support plate and providing the reinforcement. The nozzle may be formed from a hollow tubular member with longitudinally aligned sectors or openings formed in the side wall to provide passage of the molten metal to the dispensing slot. The relatively narrow slot is formed in the side wall opposite the openings. The reinforcement ribs are integrally formed between the openings. The end portions of the nozzle member are plugged to direct the molten metal through the dispensing slot. With the nozzle member inserted into the bore in the mounting plate of the crucible, the nozzle assembly is supported along its entire length. The mounting plate may include reinforcement ribs aligned with the ribs of the nozzle member when fully inserted in the plate.

11 Claims, 13 Drawing Figures

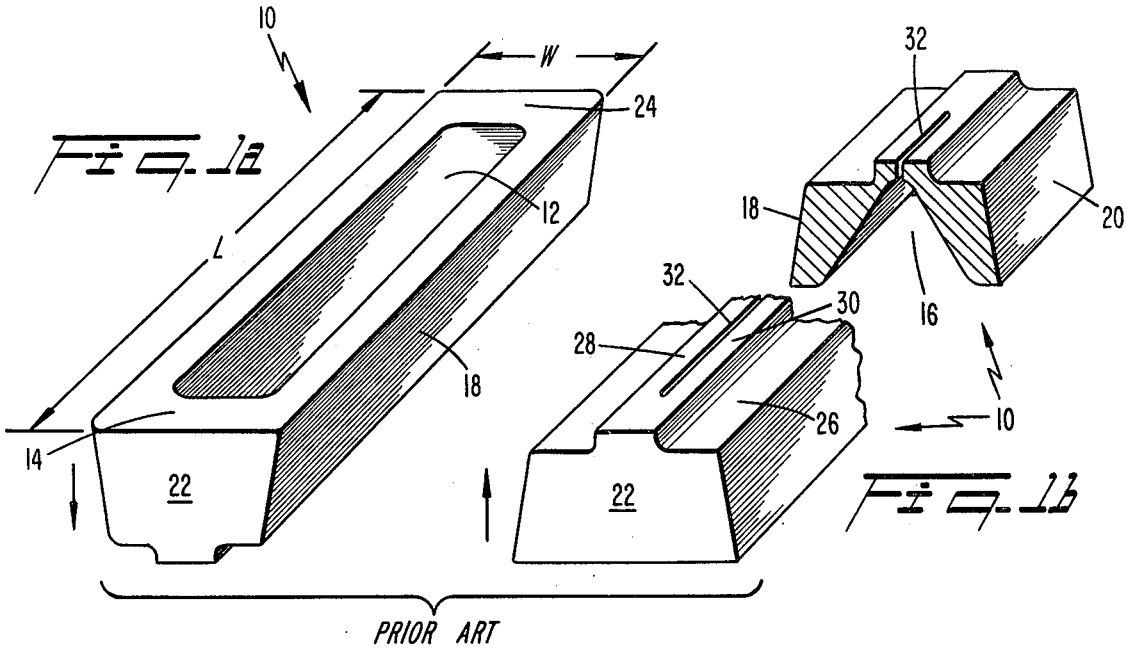
Fig. 1a
Fig. 1b
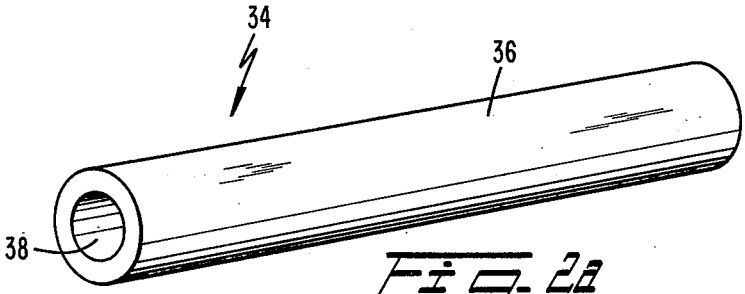
Fig. 2a
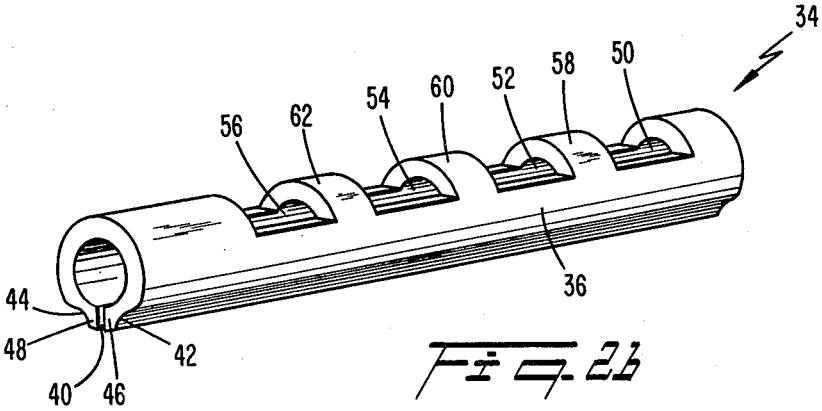
Fig. 2b

Fig. 3
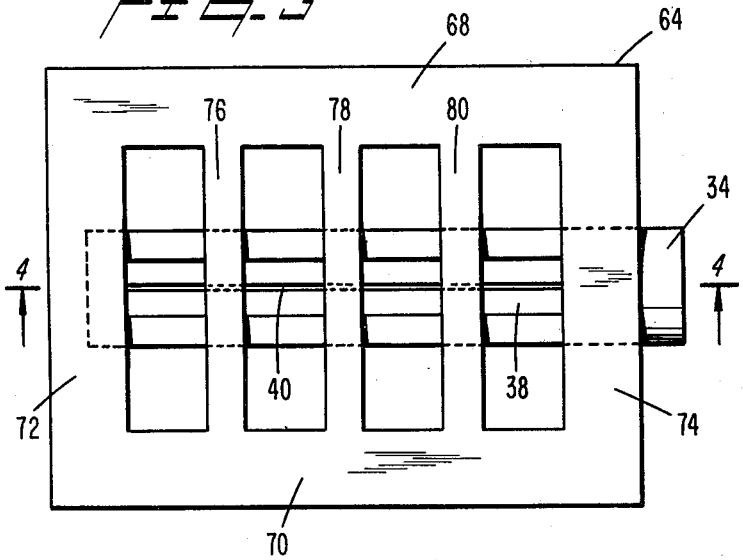
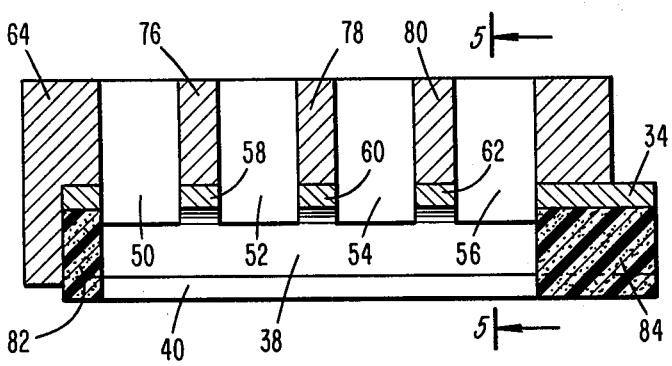
Fig. 4
Fig. 5
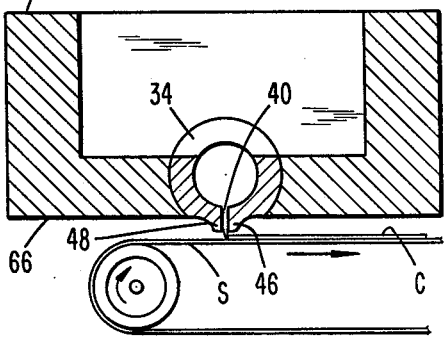
Fig. 6
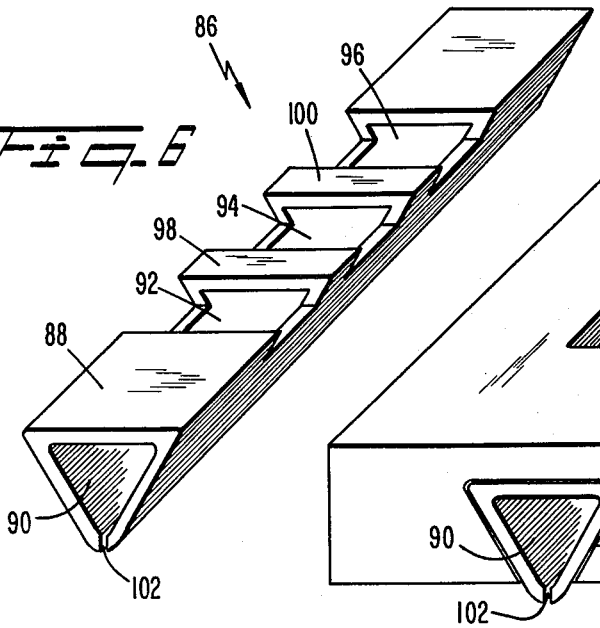
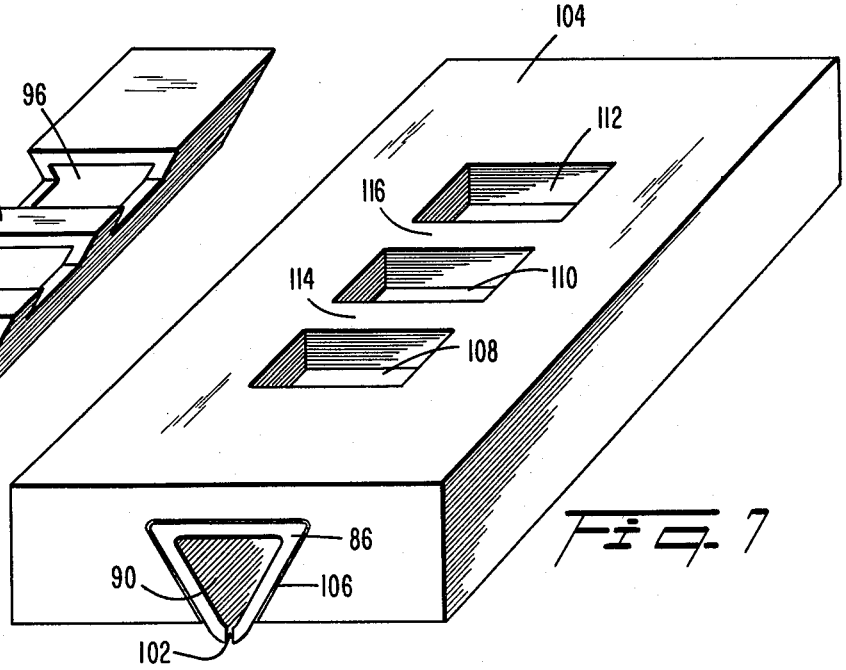
Fig. 7

CONTINUOUS CASTING NOZZLE WITH TRANSVERSE REINFORCEMENT STRUCTURE

TECHNICAL FIELD

The invention relates to nozzles of the type used in casting continuous metal strips by controllably depositing molten metal through a slot in the nozzle onto a moving chill surface adjacent the slot. In particular, the invention is directed to a structurally stable nozzle which maintains the dimensional stability of an elongated dispensing slot in the nozzle and minimizes flexing of the nozzle.

BACKGROUND OF THE INVENTION

In the process of continuously casting metal strips, such as wide ribbons, it is common practice to use a nozzle and to dispense molten metal from an elongated slot in that nozzle. The molten metal dispensed from the elongated slot is deposited or discharged onto a relatively moving chill surface positioned intimately below or adjacent the elongated slot. The molten metal solidifies soon after contact with the chill surface. Past developments in the casting of amorphous metal strips are reviewed in U.S. Pat. No. 4,142,571. Other and older methods of continuous casting are known and shown, for example, in U.S. Pat. Nos. 2,564,723 and 2,978,761.

A conventional slot nozzle for depositing molten metal in a continuous casting operation would include a body formed of a generally rectangular piece of ceramic material. The typical nozzle has a relatively large opening on one side of the body which spans virtually the entire length of nozzle. This opening extends into a hollow interior space with the nozzle, which hollow space has a converging cross sectional configuration that terminates in a relatively narrow slot. The relatively narrow slot also spans virtually the entire length of the nozzle. Molten metal enters the nozzle through the relatively large opening into the hollow interior space and is discharged through the relatively narrow slot. A typical nozzle of this type is disclosed in U.S. Pat. No. 2,128,941 and specifically illustrated in FIG. 4 thereof.

The molten metal discharged from the relatively narrow slot of the typical prior art nozzle may be deposited onto a moving substrate positioned intimately subjacent the nozzle slot. However, when the molten metal is under pressure, it may even be discharged in any direction as, for example, in U.S. Pat. No. 2,790,216 wherein molten metal is discharged upwardly into the nip of a pair of counter rotating chilled rollers.

As depicted in the FIG. 4 illustration of the aforementioned U.S. Pat. No. 2,128,941 which shows a nozzle suspended by adjustable screws secured only to the longitudinal ends of the nozzle, it is common to support the nozzle only at its end portions.

When the metal strip being manufactured has a high aspect ratio, or width to thickness ratio, the dispensing slot of the nozzle must necessarily be correspondingly long and narrow. As nozzle slots become increasingly longer to dispense increasingly wider strips or ribbon, for example, the edges of the nozzle slot have a tendency to flex along the nozzless length.

The problem of nozzle slot flexing is accentuated when only the ends of the nozzle are supported. Such flexing of the edges of the nozzle slot may alter the slot dimensions and render the slot dimensionally unstable. This may cause deleterious variations in the thickness of the cast ribbon, or even voids in the ribbon, thus destroying its integrity. The ribbon must then be discarded resulting in substantial waste, and thus extra expense. In an extreme case, the nozzle may even break at its mid-section under the resulting bending stresses. The hot molten metal is suddenly released, creating an expensive shut-down and clean-up requirement. In addition, this catastrophic failure may cause serious injury to operating personnel.

The nozzle is generally mounted in a mating ceramic crucible bottom or other mounting means. These structural elements are subject to the same bending stresses as the nozzles during use. Consequently, the mounting means (such as a plate) or crucible may flex near the mid-point of its span, aggravating the dimensional instability of the nozzle slot.

As indicated above, a nozzle is generally affixed to a mounting plate or crucible bottom from which the nozzle is supplied molten metal. The method of mounting the nozzle to the crucible bottom or mounting plate does, to some extent, influence the geometry of nozzle configurations. The upper edge of the nozzle generally has a substantially planar portion for engagement with and securement to a mating planar portion on the crucible bottom or mounting plate. The apparent geometrical limitations of prior art nozzles has precluded many otherwise available inexpensive manufacturing techniques and resulted in nozzles that are relative expensive to manufacture.

DISCLOSURE OF THE INVENTION

The present invention advances the teachings of the prior art by providing a nozzle for dispensing molten metal which has a substantially reduced tendency to flex during use. The relatively narrow slot through which the molten metal is dispensed thus becomes more dimensionally stable. The reduced tendency to flex is principally achieved through the employment of intermittent ribs which are disposed on the nozzle opposite the elongated slot. In a most preferred form of the invention, the nozzle is insertable into the end of a crucible mounting plate or crucible bottom. The mounting plate has a bore with a cross sectional configuration which matches the cross sectional configuration of the nozzle and supports the nozzle along the nozzle's entire length.

The invention also contemplates the use of a nozzle which may be inexpensively manufactured from a tubular member. Longitudinally aligned circumferential sectors are removed from the sidewall of the tubular member and are separated by non-removed circumferential sectors which function as supporting ribs. A narrow orifice is machined in the sidewall of the tubular member opposite the removed circumferential sectors, and the ends of the tubular section are then sealingly plugged.

Still other objects, advantages and features of the present invention will become readily apparent to those skilled in this art from the following description wherein there is shown and described a preferred embodiment of this invention, simply by way of illustration of some of the best modes contemplated for carrying out the invention. As it will be realized, the invention is capable of still other different embodiments, and its several details are capable of modifications in various, obvious aspects without departing from the invention.

Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings:

FIG. 1*a* is a perspective view of a conventional prior art nozzle for dispensing molten metal in the continuous casting of metal strips showing a large opening extending into the hollow interior of the chamber;

FIG. 1*b* is a fragmentary perspective view of the nozzle of FIG. 1*a* showing the long, relatively narrow discharge slot (obscured in the FIG. 1*a*) and depicting the cross sectional configuration of the interior chamber;

FIG. 2*a* is a perspective view of a section of hollow tubing member from which a nozzle body in accordance with one aspect of the present invention may be formed;

FIG. 2*b* is a perspective view of the hollow tubular member shown if FIG. 2*a* after a slot and circumferential sectors of the sidewall have been machined to form a nozzle member;

FIG. 3 is a top plan view of the machined tubular nozzle member of FIG. 2*b* as it is inserted into the end of a correspondingly ribbed crucible mounting plate;

FIG. 4 is a cross sectional elevational view of the tubular member and mounting plate of FIG. 3 taken along line 4—4 in FIG. 3;

FIG. 5 is a cross sectional view of the tubular nozzle member of FIGS. 3 and 4 taken along line 5—5 in FIG. 4 and depicting the lips of the nozzle extending below the mounting plate;

FIG. 6 is a perspective view of a machined tubular nozzle member of triangular cross sectional configuration;

FIG. 7 is a perspective view of the nozzle member of FIG. 6 as inserted into the end of a mating mounting plate and ribbed in correspondency to the machined tubular member;

Figure 8A:
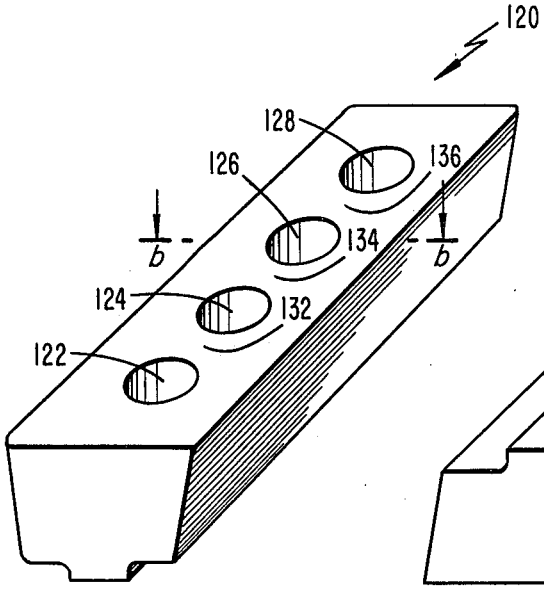
FIG. 8*a* is a perspective view of a single stage nozzle in accordance with the teachings of the present invention and showing a series of longitudinally aligned bores separated by supporting ribs.

Reference will now be made in detail to the present preferred embodiment of the invention, an example of which is illustrated in the accompanying drawings.

BEST MODE OF CARRYING OUT THE INVENTION

Reference is first made to FIGS. 1*a* and 1*b* which depict opposite sides of a conventional nozzle designated by the numeral 10 for dispensing molten metal. For the purpose of the present description, FIG. 1*a* will be identified as an upright position of the nozzle 10, while FIG. 1*b* will be identified as an upside down position of the same nozzle. Thus, while terms such as "top" and "bottom" will be used to simplify the present description, it will be understood that the nozzles may be used in any number of orientations and that such terms have meaning only insofar as the description is concerned.

The nozzle 10 has a generally rectangular configuration with a length L and a width W, the length L being substantially greater than the width W. As shown in FIG. 1*a*, an opening 12 is formed in the top wall 14 of the nozzle 10. The opening 12 spans virtually the entire length L of the nozzle 10 and provides a passage for the entry of the molten metal from a crucible (not shown) to which the nozzle 10 is affixed in a conventional manner. Molten metal entering the nozzle 10 through the opening 12 fills a holding chamber 16 (see FIG. 1*b*). The holding chamber 16 is substantially V-shaped in configuration and defined by a pair of converging sidewalls 18 and 20 and end walls 22 and 24. The end walls 22 and 24 are substantially parallel to each other and substantially perpendicular to the converging sidewalls 18 and 20. the bottom surface 26 has a pair of outstanding lips 28 and 30 which define a discharge or dispensing slot 32. The discharge slot 32, like the opening 12, spans virtually the entire length L of the nozzle 10 and extends through the bottom wall 26 to allow molten metal in the melting chamber 16 to be discharged therethrough.

It is conventional to secure the nozzle 10 to a crucible (not shown) usually adjacent end walls 22 and 24. When the nozzle length L becomes sufficiently large, as for example in the continuous casting of wide metal ribbons, there is a tendency for the nozzle 10 and the lips 28 and 30 to flex along the length L. Flexing of the lips 28 and 30 may distort the dimensions of the relatively narrow slot 32. Such distortions obviously adversely affect the integrity and quality of any metal product cast through the slot 32. As would be expected, the dimensional variance of the slot 32 is greatest near the mid point of length L.

FIG. 2*a* shows a hollow tubular member 34 of ceramic material according to the present invention. The member 34 has a continuous cylindrical sidewall 36 defining an internal flow passage 38, also of cylindrical configuration. For purposes of the present description and claims, however, the term "tubular " includes any type of similar structure that defines an internal flow passage including, but not limited to circular, square, rectangular, triangular rhomboidal and hexagonal cross sections.

In FIG. 2*b*, the tubular member 34 is depicted after being machined to form a nozzle body in accordance with the present invention. A relatively narrow longitudinal dispensing slot 40 is machined through the sidewall 36 along the entire length. As used herein, the term "narrow" is used to denote a slot operative to regulate flow, and thus approximately equal to the thickness of a cast strip C being formed on moving substrate S (see FIG. 5). Longitudinal grooves 42 and 44 along the sidewall 36 (see FIG. 2*b*) adjacent the slot 40 are also machined to define the outer edges of lips 46 and 48 on opposite sides of the slot 40.

The side of the illustrated tubular nozzle member 34 opposite the slot 40 has a series of four circumferential sectors 50, 52, 54 and 56 removed to form flow openings. These circumferential sectors 50, 52, 54 and 56 are longitudinally aligned and separated by reinforcing ribs 58, 60 and 62; reinforcing rib 58 between sectors 50 and 52, rib 60 between removed circumferential sectors 52 and 54 and reinforcing rib 62 being disposed between removed circumferential sectors 54 and 56.

Referring now to FIG. 3, the top of a ribbed rectangular crucible mounting plate 64 is shown in a cooperating relationship with a tubular insert nozzle member 34 to form a nozzle assembly. As seen more clearly in FIGS. 4 and 5, the mounting plate 64 has a bore proximal its bottom surface 66 (see FIG. 5) with a cross sectional configuration which matches and complements that of the tubular nozzle 34.

The mounting plate 64 has a pair of parallel sidewalls 68 and 70 joined by end walls 72 and 74, the end walls 72 and 74 being parallel to each other and perpendicular to the nozzle member. The upper or top surface of the walls 68, 70, 72, 74 are machined flat to mate and seal against a corresponding bottom surface of a crucible (not shown). Suitable clamping or fastening means (also not shown) accurately positions and holds the nozzle assembly in position on the bottom of the crucible.

As illustrated, three ribs 76, 78 and 80 span the distance along the sidewalls 68 and 70 between the end walls 72 and 74. It may be seen from FIG. 3 that ribs 76, 78 and 80 extend transversely across the tubular nozzle member 34 and are in direct correspondency to reinforcing ribs 58, 60 and 62 respectively. Thus, both the mounting plate 64 and tubular nozzle member 34 have reinforcing ribs extending in a direction transverse to the longitudinal direction of the nozzle membe 34 and a series of aligned openings between those ribs permit molten metal from the crucible to enter the flow passage 38.

Thus, it will be seen that nozzle 34 and mounting plate 64 both have reinforcing structures in a direction perpendicular to the longitudinal direction of the nozzle 34. Moreover, the nozzle 34 is supported along its entire length and is formed in an economical manner. With this arrangement, deleterious flexing of the assembly is prevented, thus eliminating distortions along the dispensing slot 40. As a consequence, a wide metal ribbon of exceptional uniformity and high quality may be cast.

It will be remembered that the ends of the flow passage 38 in tubular member 34 (as depicted in FIGS. 2*a* and 2*b*) are initially open. In FIG. 4, it is seen that plugs 82 and 84 are sealingly inserted in the end portions of the passage. Molten metal entering the passage 38 from the bores or recesses between the ribs 76, 78, 80 of the mounting plate 64 then exits the nozzle only through the dispensing slot 40. If desired, a ceramic adhesive containing alumina and zirconia may be used to form the plugs 82, 84 and seal the interface between the nozzle 34 and mounting plate 64, i.e., the outer surface of nozzle sidewall 36 and the mating mounting plate bore.

A further embodiment of a nozzle assembly formed in accordance to the present invention is illustrated in FIGS. 6 and 7. An insert nozzle 86 with a triangular cross sectional configuration is shown having a sidewall 88 defining a flow passage 90. A series of three longitudinally aligned circumferential sectors 92, 94 and 96 of the sidewall 88 are shown as having been removed and separated by reinforcing ribs 98 and 100. A narrow slot 102 extends through the sidewall 88 along virtually the entire length of the tubular nozzle 86. Like the previously described embodiment, the narrow slot 102 is disposed opposite (approximately 180°) the removed circumferential sectors 92, 94 and 96.

A mounting plate 104 having a bore 106 with a matching triangular cross sectional configuration receives the tubular nozzle 86 through its end and, like previously described mounting plate 64, supports the nozzle along its entire length. The mounting plate 104 has openings 108, 110 and 112 in alignment with the removed circumferential sectors 92, 94 and 96 when the nozzle 86 is fully inserted. Similarly, the openings 108 and 110 are separated by a reinforcing rib 114 and openings 110 and 112 are separated by a reinforcing rib 116 with the reinforcing ribs 114 and 116 being in alignment with the reinforcing ribs 98 and 100 when the nozzle 86 is inserted in the mounting plate 104.

Although not depicted in the illustrations of FIGS. 6 and 7, the end portions of flow passage 90 are sealingly plugged to direct molten metal from openings 108, 110, 112 to mix and then discharge through the dispensing slot 102. Again, if desired, a ceramic adhesive containing alumina and zirconia may be used to seal the ends, and fix the nozzle sidewall 88 against the mating sidewall of the bore 106.

Figure 8B:
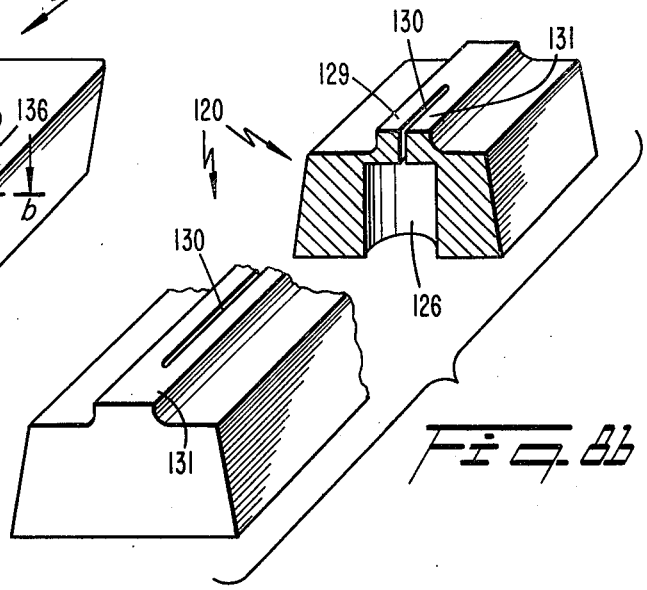
FIG. 8*b* is a fragmentary perspective view of the nozzle of FIG. 8*a* showing a cross sectional view of the nozzle taken along line b—b in FIG. 8*a*.

Another embodiment illustrating one aspect of the present invention is depicted in FIGS. 8*a* and 8*b*. A single piece nozzle 120 is shown closely resembling the prior art nozzle of FIGS. 1*a* and 1*b*. However, the embodiment of FIGS. 8*a* and 8*b*, rather than having a large internal flow passage has a plurality of bores 122, 124, 126 and 128 extending downwardly therethrough in direct fluid communication with a relatively narrow slot 130 extending through the bottom of the nozzle 120. The molten metal from the bottom of the adjacent bores 122, 124, 126, 128 mixes in the upper portion of narrow continuous dispensing slot 130 (see FIG. 8*b*) thus providing a full width and uniform casting.

The mouth of the dispensing slot 130 is defined by substantially parallel lips 129 and 131 extending longitudinally along the bottom of the nozzle 120. As will be evident, the top surface of the nozzle 120 is machined and in use is mated and clamped on the bottom of a suitable crucible (not shown) containing a supply of molten metal.

The bores 122 and 124 are separated by a rib 132 extending transverse to the longitudinal direction of the nozzle and substantially perpendicular to the slot 130. Bore 126 is similarly separated from bores 124 and 128 by transversely extending ribs 134 and 136 respectively. It should be apparent from viewing FIGS. 8*a* and 8*b* that the bores 122, 124, 126 and 128 may be formed by a drilling operation simply leaving solid ceramic ribs in between. The employment of the rigid reinforcing ribs 132, 134 and 136 between the bores minimizes flexing or distortion of the nozzle 120, and the longitudinal lips 129 and 131 in particular, during use, thus maintaining the dimensions of the slot 130 constant and the resultant ribbon of the highest quality.

Figure 9A:
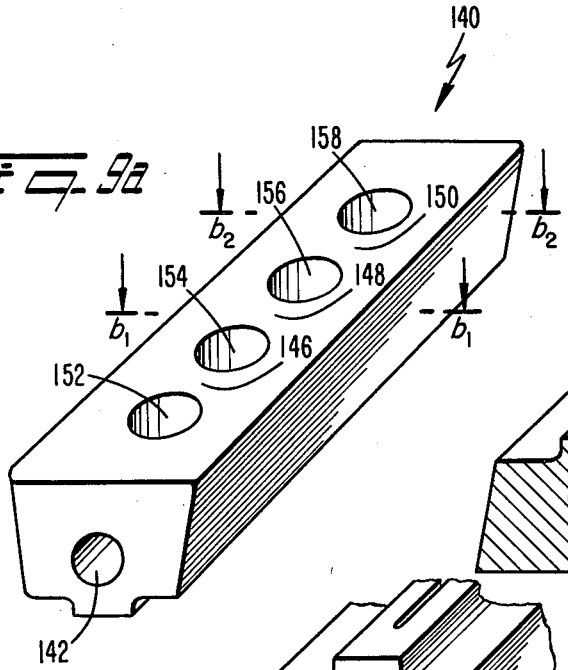
FIG. 9*a* is a perspective view of a further embodiment of the nozzle of the invention in which a melt reservoir leading directly to a discharge slot is formed by drilling through the length of the nozzle.
Figure 9B:
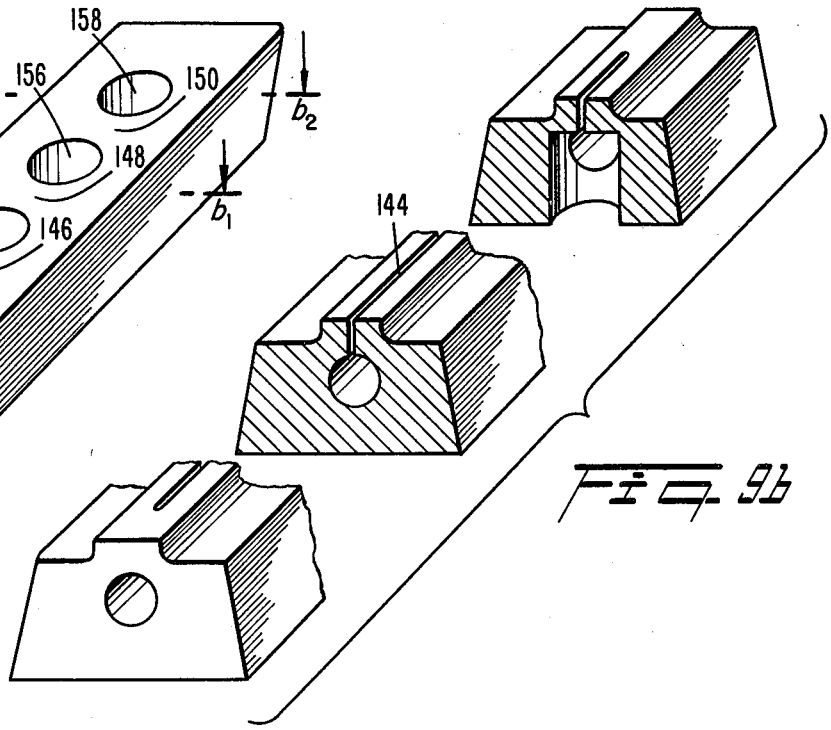
FIG. 9*b* is a fragmentary perspective view of the nozzle of FIG. 9*a* showing the opposite side of the nozzle and cross section views across lines b1—b1 and b2—b2 in FIG. 9*a*.

In FIGS. 9*a* and 9*b*, a nozzle 140 has been modified from a nozzle similar to that of FIGS. 8*a* and 8*b* by drilling through the length of the nozzle 140 to form an enlarged flow passage 142. This enlarged passage allows freer mixing action between the dispensing slot 144 and the bores 152, 154, 156, 158 adjacent the bottom of the nozzle 140. The enlarged passage also assures a more uniform molten metal pressure distribution to be exerted along the length of the dispensing slot. A set of structurally reinforcing ribs 146, 148 and 150 thus separate drilled bores 152, 154, 156 and 158 in the top of nozzle 140. Like the mixing passages of the tubular nozzles described above, the mixing passage 142 is sealingly plugged at its ends to direct the molten metal entering the nozzle 140 through bores 152, 154, 156 and 158 to exit through the dispensing slot 144.

In summary, numerous benefits have been described which result from employing the concepts of the invention. The invention contemplates an improved nozzle not subject to flexing along its length and which may be manufactured inexpensively. The improved nozzle preferably has a plurality of intermittent reinforcing ribs on the side of the nozzle opposite the dispensing slot used to dispense molten metal. These intermittent reinforcing ribs are formed integrally with the nozzle by removing material from a cast ceramic body. The intermittent ribs extend in a direction transverse to the longitudinally extending slot. A nozzle insert member is supported along is entire length, as for example, by inserting a tubular nozzle member into a mating bore of a mounting plate. Longitudinally aligned sectors of the tubular member define openings for feeding the molten metal to the slot with intermittent sectors remaining to serve as the integral reinforcing ribs. The matching intermittent reinforcing ribs on the mounting plate provide further strength to the assembly.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A nozzle for dispensing molten metal to form a cast strip comprising:

a hollow tubular member;

a slot in said tubular member for discharging molten metal therethrough, said slot extending through said tubular member in a predetermined direction; and a series of openings forming at least a portion of said tubular member for receiving molten metal to be discharged, said openings being aligned in said predetermined direction and separated by ribs extending in a direction transverse to said predetermined direction, said openings being in fluid communication with said slot through said tubular member.

2. A nozzle as recited in claim 1, wherein the tubular member is elongated and the predetermined direction is the longitudinal direction of the tubular member.

3. A nozzle as recited in claim 2, wherein said openings are disposed in said tubular member approximately 180 degrees from said slot.

4. A nozzle as recited in claim 3, wherein said slot is define by a pair of longitudinally extending parallel lips extending along the tubular member.

5. A nozzle as recited in claim 4, wherein the end poritons of said hollow tubular member are sealingly plugged to direct molten metal entering said member through said openings to exist through said slot.

6. An insertable nozzle assembly for dispensing molten metal for forming a cast strip, comprising:

a hollow mounting means, said mounting means having a bore extending from one side toward the other; and a hollow elongated tubular nozzle member having a dispensing slot longitudinally extending through the sidewall thereof, said nozzle member having opening means in its sidewall circumferentially separated from said dispensing slot for allowing entry of molten metal from said mounting means, said nozzle member having a cross sectional configuration substantially matching the cross sectional configuration of said bore and being insertable therein for reinforcement.

7. An insertable nozzle assembly as recited in claim 6, wherein said opening means includes a plurality of longitudinally aligned openings in the sidewall of the tubular nozzle member separated by ribs extending in a direction transverse to said dispensing slot.

8. An insertable nozzle assembly as recited in claim 7, wherein said mounting means supports said nozzle along substantially the entire length of the nozzle.

9. An insertable nozzle assembly as recited in claim 8, wherein said hollow mounting means has a plurality of ribs extending transverse to said dispensing slot and corresponding to the ribs in said nozzle member to minimize flexing of said nozzle assembly for uniform passage of molten metal.

10. An insertable nozzle assembly as recited in claim 9, wherein said mounting means includes a hollow mounting plate, the ribs of said nozzle member being aligned with ribs in said mounting plate when said member is fully inserted into said mounting plate.

11. An insertable nozzle assembly as recited in claim 10, wherein the dispensing slot is defined by a pair of longitudinally extending parallel lips which extend along the nozzle member.

* * * * *